US006148754A

United States Patent [19]

Sims, Jr.

[11] Patent Number: 6,148,754

[45] Date of Patent: Nov. 21, 2000

[54] BOAT KEEL/HULL PROTECTOR

[75] Inventor: Carlie Lee Sims, Jr., 6908 Sandstone Blvd., Louisville, Ky. 40219

[73] Assignee: Carlie Lee Sims, Jr., Louisville, Ky.

[21] Appl. No.: 09/312,171

[22] Filed: May 14, 1999

Related U.S. Application Data

[60] Provisional application No. 60/085,576, May 15, 1998.

[51] Int. Cl.[7] ..... B63B 59/02

[52] U.S. Cl. ..... 114/219; 114/343

[58] Field of Search ..... 114/219, 343, 114/361, 140

[56] References Cited

U.S. PATENT DOCUMENTS

| | | | |
|---|---|---|---|
| 3,055,022 | 9/1962 | Vallquist . | |
| 3,220,026 | 11/1965 | Lichti . | |
| 3,261,320 | 7/1966 | Leonard . | |
| 3,411,304 | 11/1968 | Miller | 114/219 |
| 4,751,891 | 6/1988 | Wilson . | |
| 4,762,080 | 8/1988 | Pearson . | |
| 4,803,942 | 2/1989 | Dren et al. . | |
| 4,909,172 | 3/1990 | Hamby . | |
| 4,962,719 | 10/1990 | Hughes et al. . | |
| 5,215,031 | 6/1993 | Inman et al. . | |
| 5,299,521 | 4/1994 | Loucks . | |
| 5,357,890 | 10/1994 | Mason, Jr. et al. . | |
| 5,398,631 | 3/1995 | Miller . | |
| 5,485,801 | 1/1996 | Gibbs . | |
| 5,803,010 | 9/1998 | Roy et al. | 114/219 |
| 5,891,551 | 4/1999 | Gibbs | 428/156 |

OTHER PUBLICATIONS

KeelShield, Inc., *Attack Back*, circa 1997.

Mega–Ware Inc., *Keel Guard Bottom Protection*, circa Nov. 13, 1993.

*Primary Examiner*—Sherman Basinger

*Attorney, Agent, or Firm*—Wood, Herron & Evans, L.L.P.

[57] ABSTRACT

A protective device to be installed onto the keel or hull of a watercraft, such as the pontoon of a pontoon boat can be easily installed by a boat owner without professional assistance. Furthermore, the protective device is securely attached to the bow of the boat and provides effective impact resistant protection to the bottom of the boat without detaching or degrading over time.

23 Claims, 2 Drawing Sheets

BOAT KEEL/HULL PROTECTOR

This claims the benefit of U.S. Provisional patent application Ser. No. 60/085,576, filed May 15, 1998 and hereby incorporated by reference in its entirety.

BACKGROUND OF THE INVENTION

This invention relates to surface protection equipment for boats and, more particularly, to novel apparatus and methods for shielding the keel and/or hull of a watercraft from abrasive damage and which is capable of being easily installed.

Watercraft such as, for example, pontoon boats motorboats, jet skis, wave runners, yachts, sailboats, kayaks and canoes are generally formed of a fiberglass, thin metal or composite material which can become easily damaged, dented or seriously scratched as a result of forcible impact or collision with sand, gravel, rocks or other obscure objects or debris found in water or on a shoreline. Typically, when a watercraft is beached, removed from and/or launched into water, or while the watercraft is merely moving through the water, the lowermost portion of the hull of the watercraft (generally encompassing portions of the stem, bow, forefoot, keel and stern) is particularly susceptible to abrasion or damage. Consequently, abrasive damage usually promotes corrosion and structural weakening of the hull of the watercraft in addition to being cosmetically displeasing. Furthermore, the bow of a watercraft may procure serious damage as a result of forcible contact with the shoreline, beach or docking platform where the watercraft is secured.

Traditionally, the keel and hull of a watercraft are generally formed having a substantially arcuate shape which structurally encourages the hydrodynamic flow of water across the exterior surface of the hull as the watercraft moves through the water. The hydrodynamic performance of a watercraft, however, can be sufficiently reduced as a result of serious abrasions disposed on the keel and/or hull of the watercraft. In this regard, serious damage such as, for example, deep scratches, penetration or abrasions in the exterior surface of the hull of a watercraft, typically generate substantial dragging or suction forces acting against the motion of the immersed watercraft and, more importantly, can seriously affect the overall hydrodynamic performance of the watercraft in water. Moreover, serious abrasions in the hull and/or keel of a watercraft particularly formed of relatively thin metal or fiberglass will generally necessitate the repair and/or replacement of the hull, pontoon and/or those structural features of the body of the watercraft functionally affected.

The repair and/or replacement of the hull, keel or pontoon of a watercraft is customarily costly, and typically sorely inconvenient to the owner of the watercraft. Accordingly, the capacity for protecting the keel, hull and/or bow of a watercraft from abrasive wear and tear, damage or deep scratching has encouraged significant concentration and development within the boating industry as to the various options available for protecting the hull of a watercraft and while reducing the cost of repair and maintenance of the exterior surface thereof, while substantially preserving the monetary value of the watercraft itself.

In an attempt to structurally accommodate the ability to protect at least a portion of the lowermost portion of a watercraft from structural damage caused by abrasion and deep scratching, those skilled in the art developed prior art bow protectors. A serious disadvantage associated with bow protectors of the prior art, however, is their general inability to adequately absorb impact forces, conform over the keel or hull of a particularly engineered keel or hull configuration or design of a specific make or model of watercraft.

Traditionally, prior art bow protectors are designed and manufactured as a preformed unit having a substantially rigid configuration. Moreover, the material comprising prior art bow protectors is usually only slightly deformable when disposed over the particular configuration of the bow or keel of the watercraft. In this regard, since the design and configuration of a hull of a watercraft is not universal in nature or in application with other watercraft, preformed prior art bow protectors are typically unable to provide sufficient universal conformity over the keel or hull of various sizes or shapes of watercraft. Similarly, because the manufacturing of prior art bow protectors in various shapes and sizes for different makes and models of watercraft can be economically impractical, prior art bow protectors are usually molded or preformed in conventional shapes and sizes which attempt to provide an approximate conformity over the keel or bow of the various watercraft upon installation.

Other practical disadvantages with bow protectors of the prior art have also emerged in relation to the installation of bow protectors over the keel or hull of the watercraft. For example, to properly install prior art bow protectors over a nonconforming keel or hull of a watercraft, at least two skilled installers are typically required who generally apply compression forces against the preformed body of the prior art bottom protector in order to bend or alter the shape of the bow protector to minimally conform over the keel or bow of the watercraft. In this regard, prior art bow protectors are generally installed by skilled technicians with special training in the installation process and having the necessary tools to minimize the various problems that may arise during the installation process. These and other problems with known bow protectors have generally limited their installation to professionals and thereby significantly restricting the market and availability for do-it-yourself-type installations.

In addition to the foregoing disadvantages, prior art bow protectors generally promote hydrodynamic dragging or suction forces which act against the exterior surface of the keel or hull of the watercraft. Since prior art bottom protectors are commonly secured to the exterior surface of the watercraft by means of spacer blocks and an epoxy adhesive, when prior art bow protectors are unable to be substantially conformed over the configuration of the keel or hull of the watercraft, the force of the water resistance against the keel or hull of the watercraft as it moves through the water, typically overwhelms the securing means provided by the adhesive epoxy of the bow protector. In this regard, prior art bow protectors typically become detached from the exterior surface of the watercraft and correspondingly, reduce the hydrodynamic performance of the watercraft and minimize the protection from impact.

Furthermore, bow protectors of the prior art are usually formed of a clear plastic material comprising a molecular composition which can be sufficiently degraded as a result of persistent contact with ultraviolet light. Ultraviolet light typically breaks down or alters the chemical structure of the clear plastic material and generally results in the discoloration of the plastic to display a slightly yellowish tint. Moreover, long exposure to ultraviolet light can cause the clear plastic of prior art bow protectors to become separated from the surface of the watercraft as a result of the chemical breakdown of the adhesive applied to the backing of the prior art bow protector and the exterior surface of the keel or hull.

Therefore, there is a significant need for a bow protector for boats, ships, pontoon boats and watercraft generally which can be easily installed by the boat owner and does not significantly degrade the hydrodynamic performance of the watercraft while providing effective impact resistant protection to the bottom of the boat without detaching or degrading over time.

SUMMARY OF THE INVENTION

These and other objectives of the invention have been obtained by an improved protective device for the keel and/or hull of a watercraft according to this invention. In a presently preferred embodiment, the invention is specifically adapted for use for the protection of a pontoon on a pontoon boat and is embodied in the form of an elongate bumper which has a generally V-shaped cross-sectional configuration with a pair of wings joined together at their proximal ends to each other at a bight of the bumper. A number of generally equally spaced keyhole-shaped slots are formed on an inner face of each wing proximate the bight of the bumper to cushion impact to the keel of the pontoon, hull or the like when the bumper is installed thereon. Additionally, the keyhole slots assist in conforming the bumper to the geometry, profile or configuration of the bow of the boat. Preferably, the bumper is attached to the pontoon by adhesive and, more preferably, in the form of a pressure sensitive double-sided adhesive tape attached on an inner face of each wing proximate a distal end thereof.

At least one notch is formed in each wing to permit bending and articulation of the bumper around a transverse or lateral axis to conform the bumper to the profile of the keel, hull or pontoon and thereby avoid gaps or buckling in the bumper when applied to the pontoon. Each of two alternative presently preferred embodiments of this invention is specifically adapted for conforming to either of two pontoon shapes commonly in use on pontoon boats. Specifically, a right-angle pontoon includes a generally linear forward section projecting angularly downward from the top leading edge of the pontoon to a sharp bend where the V-shaped notch in each wing would be located to conform the bumper to the right-angle pontoon and avoid any gaps in the bumper applied thereto. Alternatively, a more smoothly arcuate-shaped pontoon or keel includes a number of notches to conform the bumper to the profile of such a pontoon.

This invention also includes a convenient and easy method for installing the bumper onto the keel, hull or pontoon of a boat which can be easily accomplished by a single individual such as the boat owner or the like without the assistance of a professional installer. The double-sided adhesive tape located on the interior face of each wing assists in the convenient and easy installation of the bumper to attach the wings to the pontoon. Furthermore, a generally T-shaped support ensures that the vertex or leading edge of the pontoon, keel or hull is fully seated within the V-shaped bumper prior to finally adhesively securing the bumper thereto.

As such, the present invention, including the protective device for the keel or hull of a pontoon or other type of boat and the associated method for installing the protective device or bumper, readily provide for a secure and conforming fit of the protective device onto the boat and does not significantly degrade the hydrodynamic performance of the boat when installed thereon while still providing effective impact resistant protection to the bottom of the boat without detaching or degrading over time.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
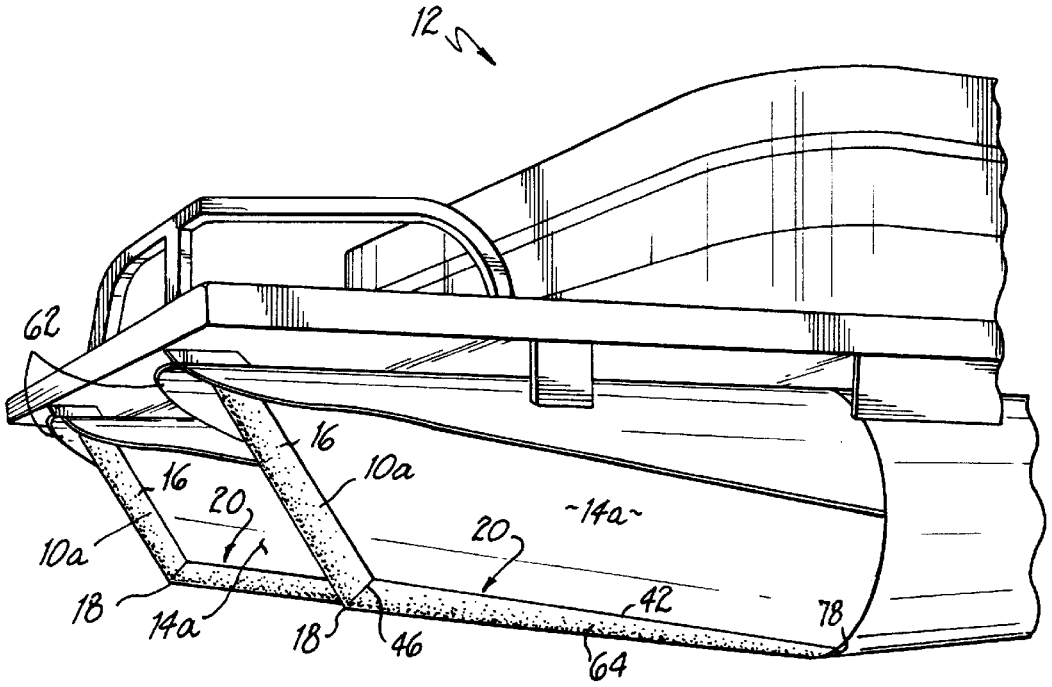
FIG. 1 is a perspective view of a first presently preferred embodiment of a protective device installed onto each pontoon of a pontoon boat.

The following detailed description illustrates the invention by way of example, and not by way of limitation. This description will clearly enable one skilled in the art to make and use the invention and describe several embodiments, adaptations, variations, alternatives and uses of the invention, including what I presently believe to be the best mode of carrying out the invention.

In the drawings, the invention is shown as used in conjunction with a pontoon boat, although it will be understood that the protective device and method of installation may well be used with other types of boats and watercraft where it is necessary to protect the hull, keel or similar structure of a boat, particularly during beaching of the boat.

Referring to FIG. 1, a first presently preferred embodiment of the protective device according to this invention is shown as a bumper 10, one of which is applied to the bow of a pontoon boat 12 on one of the pontoons 14 thereof. The shape of the pontoon 14 particularly shown in FIG. 1 is referred to as a right-angle pontoon 14*a* in that the leading edge of the pontoon 14*a* at the bow of the boat 12 includes a generally linear portion 16, typically 17 to 20 inches in length, extending angularly downwardly from the upper portion of the pontoon 14*a* toward a corner or bend 18 in the pontoon 14*a*. A lower portion 20 of the pontoon 14*a* extends from the corner bend 18 and forms an angle of approximately 130° to 155° with respect to the leading edge portion 16 of the right-angle pontoon.

Figure 2:
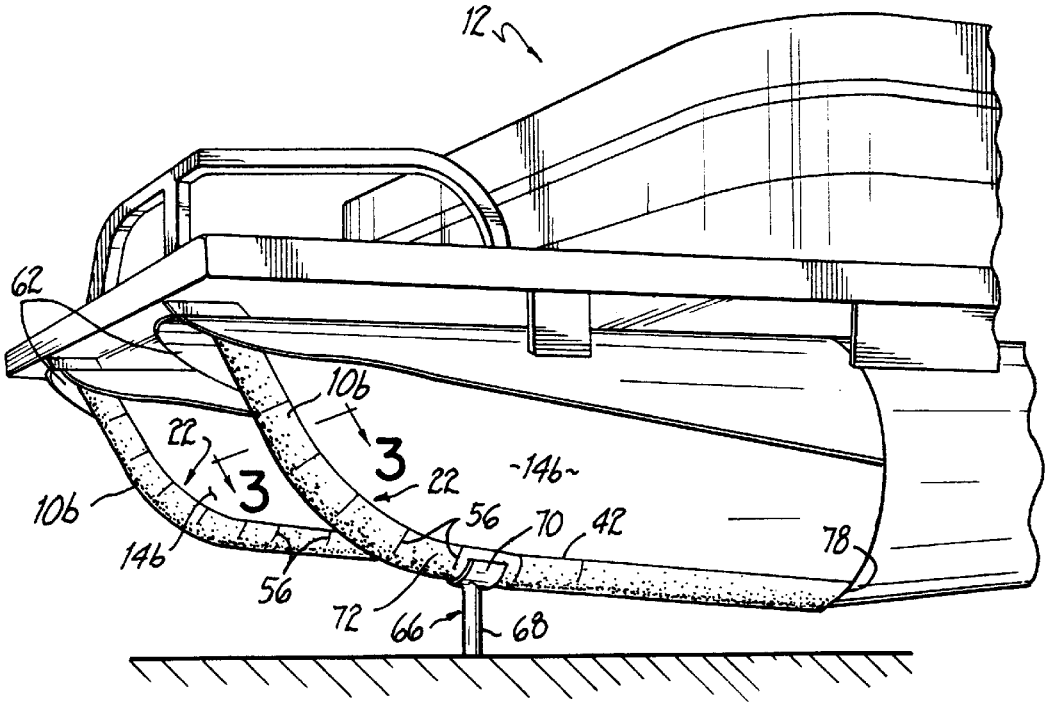
FIG. 2 is a view similar to FIG. 1 of a second presently preferred embodiment of the invention.

Referring to FIG. 2, a second presently preferred embodiment of the invention is shown as a bumper 10 installed onto a radius-shaped pontoon 14*b*. As differentiated from the right-angle pontoon 14*a* shown in FIG. 1, the radius-shaped pontoon 14*b* on the boat 12 of FIG. 2 includes a smoothly continuous arc 22 along the leading edge of the pontoon 14*b* onto which the protective bumper 10 is attached.

Figure 3:
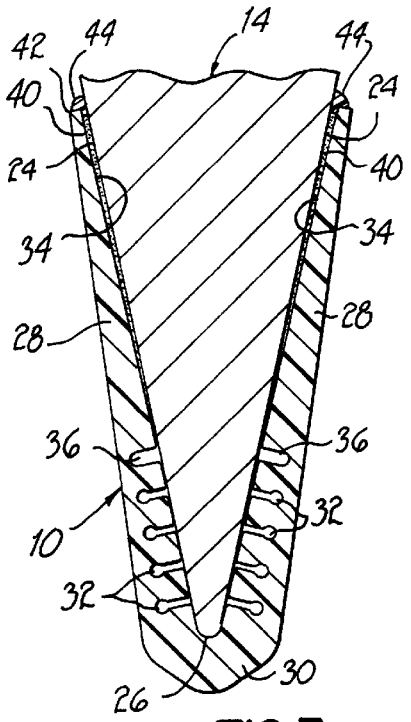
FIG. 3 is a cross-sectional view taken along line 3—3 of FIG. 2.
Figure 4:
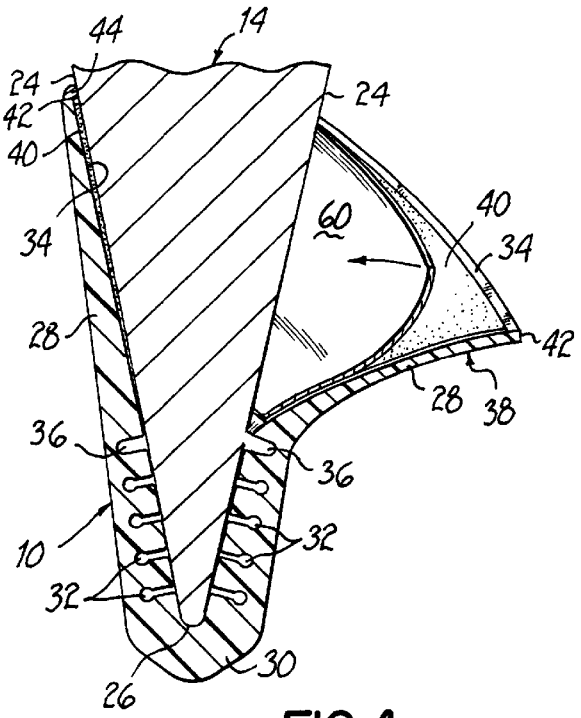
FIG. 4 is a view similar to FIG. 3 with the adhesive on one of the wings being exposed prior to application thereof to the pontoon.

Referring to FIGS. 3 and 4, in both pontoon shapes 14*a* and 14*b*, a pair of pontoon sidewalls 24 converge at a vertex 26. The protective bumper 10 to be applied to the pontoon 14 according to a presently preferred embodiment of the invention has a generally V-shaped cross-sectional configuration, as shown in FIGS. 3 and 4, with a pair of wings 28 joined together at their proximal ends to each other at a bight 30 of the cross-sectional configuration of the bumper 10.

Each wing 28 is juxtaposed to one of the sidewalls 24 of the pontoon 14 with the vertex 26 of the pontoon 14 seated within the bight 30 of the bumper 10. Each wing 28 includes a number of generally equally spaced keyhole-shaped slots 32 on an inner face 34 thereof proximate the bight 30 of the bumper 10. In the embodiments shown in FIGS. 3 and 4, four keyhole-shaped slots 32 are spaced on each wing 28. The shape, configuration and position of the keyhole slots 32 assist in absorbing shock or impact forces delivered to the pontoon 14 or bow of the boat 12 thereby providing a protective impact resistant covering. Additionally, the keyhole-shaped slots 32 allow the bumper 10 to bend and conform more readily to the shape and configuration of the bow or pontoon 14 of the boat 12 to thereby provide a tight and secure fit therewith. An additional slot 36 is preferably provided in each wing 28 which enables an upper portion 38 of each wing 28 to be bent, as shown in FIG. 4, for access to a layer of adhesive 40 conveniently provided on the inner face 34 of each wing 28 proximate the distal end edge 42 thereof.

In a presently preferred embodiment, the layer of adhesive 40 is approximately two inches wide and is preferably Avery Dennison double adhesive tape product no. Avery 2453 with a thickness of 0.060 inches. The wings 28 are preferably angled approximately 25° relative to one another prior to installation on the pontoon 14 and the length of each wing 28 from the lowermost keyhole slot 32 to the distal edge 42 thereof is approximately 3.23 inches. The overall vertical height of the bumper 10 is approximately 3.72 inches. The wings 28 merge together and the width of the bumper 10 at their intersection is approximately 0.86 inches.

Preferably, the bumper 10 is formed of a 90 durometer PVC plastic with UV protection added. Preferably, the bumper 10 is blue, burgundy, red, teal or tan, each color of which avoids degradation due to the elements over time and provides an aesthetically pleasing protective cover onto the bow of the boat 12.

Preferably, a layer or bead of sealant 44, such as HV350 sealant, which is commercially available from Valco of Cincinnati, Ohio is applied to the edges of the bumper 10 adjacent the pontoon 14.

Figure 6:
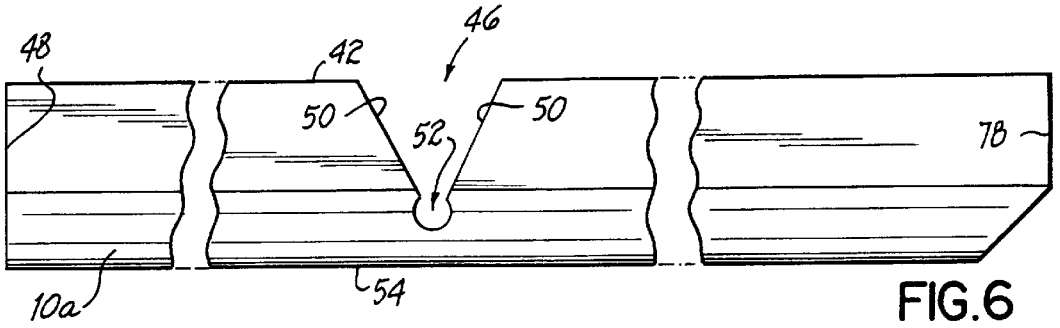
FIG. 6 is a view similar to FIG. 5 with respect to the embodiment of FIG. 1.

Referring to FIG. 6, the bumper 10 for use on the right-angle pontoon 14*a* as shown in FIG. 1 includes a generally V-shaped notch 46 in each wing 28 at corresponding positions along the length thereof. The bumper 10*a* of FIG. 6 is preferably about 58 inches in length and the V-shaped notch 46 is centered approximately 22.25 inches from the leading edge 48 thereof. The sidewalls 50 of the V-shaped notch 46 form approximately a 40.4° angle with respect to each other and terminate in a generally circular portion 52 with a diameter of approximately 0.7754 inches. Preferably, the circular portion 52 is spaced approximately 0.8204 inches from a bottom edge 54 of the bumper 10. The V-shaped notch 46 is provided in the bumper 10*a* for the right-angle pontoon 14*a* so that the bumper 10*a* may be bent or formed about a lateral axis thereof at the bend 18 and the sidewalls 50 of the V-shaped notch 46 are juxtaposed to one another to form a continuous fit of the bumper 10*a* around the bend 18 and onto the right-angle pontoon 14*a* as shown in FIG. 1.

Figure 5:
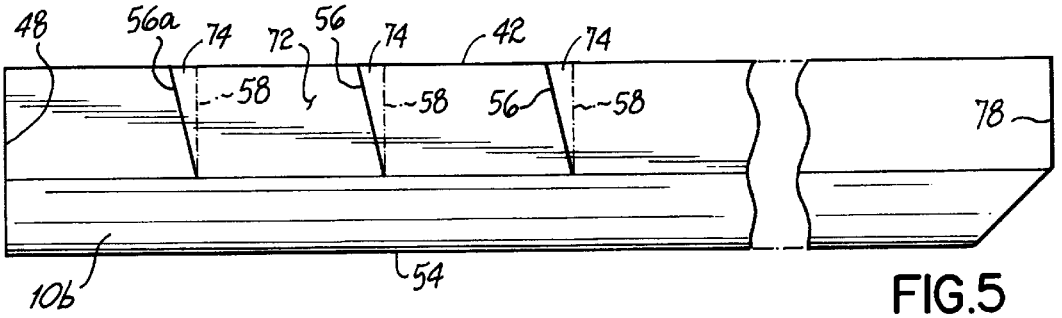
FIG. 5 is a plan view of the embodiment of the invention shown in FIG. 2 prior to installation onto the pontoon boat.

Referring to the embodiment of the bumper 10 shown in FIG. 5 for application to a radius-shaped keel as shown in FIG. 2, this embodiment of the bumper 10*b* initially includes preferably six slits angled at about 77° formed in the wings 28 of the bumper 10*b* at corresponding locations. Preferably, a first slit 56*a* is spaced approximately 9.75 inches from the leading edge 48 of the bumper 10*b* and subsequent slits 56 are spaced approximately 5.25 to 5.5 inches from one another. The slits 56 terminate at a point approximately 1.53 inches from the bottom edge 54 of the bumper 10*b*. The bumper 10*b* according to the embodiment shown in FIG. 5 is approximately 54 inches in length. The slits 56 are used to form V-shaped notches in the bumper during installation by cutting each wing 28 along a line 58 shown as dashed line in FIG. 5. The resulting notches in the bumper 10*b* provide for a smooth and continuous fit onto the radius-shaped pontoon 14*b*, as shown in FIG. 2.

The preferred method for installing the protective device or bumper 10 according to this invention is an incremental process which attaches a portion of the bumper 10 at a time starting with the leading edge 48. The method begins with spreading the wings 28 of the bumper 10 at the leading portion 48 thereof and inserting the leading portion 48 of the bumper 10 onto the keel or upper edge of the pontoon 14 and tapping it with a mallet until the vertex 26 seats in the bight 30 for a snug fit prior to securing it with the adhesive tape 40. Each wing 28 of the leading portion 48 is then bent as shown in FIG. 4 to expose the adhesive tape 40 and remove a protective cover 60 thereon. One wing 28 at a time should be applied to the leading portion 48 of the pontoon 14 by removal of the protective cover 60 and application of the double-sided adhesive tape 40. Once the protective cover 60 is removed, pressure with the palm of the installer's hand should be applied to the sidewall 24 to assure adhesive contact of the wing 28 with the aluminum surface of the pontoon 14. Trimming of the upper edge of the leading portion 48 of the bumper may be required for conformance with a splash guard 62 of the pontoon boat 12. For the right-angle pontoon 14*b* compatible bumper 10*b*, the trailing portion 64 is then likewise attached with the sidewalls 24 of each wing 28 of the notch 46 juxtaposed together at the bend 18.

Subsequently, for installation of the bumper 10*b* of FIG. 5, the pontoon boat 1 2 is raised for installation of a T-shaped support 66, as shown in FIG. 2. The support 66 includes a generally vertical stem 68 having a cradle-shaped support member 70 mounted on the upper end thereof. Once the pontoon 14*b* is raised on a trailer (not shown) or the like for positioning of the T-shaped support bar 66 as shown in FIG. 2, the pontoon 14*b* can be lowered until it is supported by the T-shaped support bar 66. Initially, the support 66 should be positioned as close to the portion of the bumper 10*b* to be attached as possible. The portion 72 of the bumper 10 are defined by the slits 56 or notch 46. The portion 72 of the bumper 10*b* immediately aft of the previously attached portion 72 and immediately forward of the support 66 is then tapped for securely seating the vertex 26 of the pontoon 14 into the bight 30 of the bumper 10. V-shaped notches are then formed from the slit 56 by cutting or slicing an overlapping portion 74 of each wing 28 with a straight edge guide (not shown) and knife or the like along a cut line 58. This should be accomplished for each portion 72 from the leading edge 48 toward the sloped back edge 78 of the bumper 10 at each subsequent notch location. As each notch is completed, the protective cover 60 on the adhesive tape 40 of each wing 28 of that portion 72 of the bumper 10 is removed and the wing 28 is firmly adhesively attached to the sidewall 24 of the pontoon 14. Subsequently, the pontoon boat 12 is then lowered and the support 66 repositioned so it is immediately adjacent to the portion 72 of the bumper 10 which will then be adhesively secured to the pontoon 14. The process continues until the entire bumper 10 is attached to the radius-shaped pontoon 14*b*.

After the bumper 10 is installed as described, the sealant 44 may be applied to exposed edges of the bumper 10 adjacent to the surfaces of the pontoon 14 as shown in FIGS. 3 and 4. As such, the installation of the bumper 10 can be easily accomplished by an individual without the need for professional assistance. Furthermore, the bumper 10 is firmly seated onto the pontoon 14 to provide protection against impact and shock when beaching the pontoon boat 12 or encountering debris in the water during operation.

From the above disclosure of the general principles of the present invention and the preceding detailed description of at least one preferred embodiment, those skilled in the art will readily comprehend the various modifications to which this invention is susceptible. Therefore, I desire to be limited only by the scope of the following claims and equivalents thereof.

What is claimed is:

1. A protective device for a keel of a pontoon on a pontoon boat, the protective device comprising:

an elongate bumper having a generally V-shaped cross-sectional configuration with a pair of wings joined together at their proximal ends to each other at a bight of the cross-sectional configuration of the bumper;

a plurality of equally spaced keyhole shaped slots on an inner face of each wing proximate the bight of the bumper to cushion impact to the keel of the pontoon when the bumper is installed thereon and assist in conforming the bumper to the configuration of the keel of the pontoon;

a layer of pressure sensitive adhesive tape on the inner face of each wing proximate a distal end thereof and spaced from the keyhole slots, the pressure sensitive adhesive tape being used to secure the bumper to the keel of the pontoon;

at least one generally V-shaped notch in each wing at corresponding locations in the wings to permit bending and articulation of the bumper to conform to the profile of the keel of the pontoon without substantial gaps in the bumper;

a sealant applied to each of the exposed ends, edges and at intersections of the bumper and the pontoon after the bumper is applied to the keel of the pontoon to inhibit water from entering between the bumper and the pontoon.

2. A protective device adapted to be applied to a bottom of a boat, the protective device comprising:

an elongate bumper having a generally V-shaped cross-sectional configuration with a pair of wings joined together at their proximal ends to each other at a bight of the cross-sectional configuration of the bumper;

a plurality of spaced slots on an inner face of each wing proximate the bight of the bumper to cushion impact to the bottom of the boat when the bumper is installed thereon and assist in conforming the bumper to the configuration of the bottom of the boat; and an adhesive on the inner face of each wing proximate a distal edge thereof and being adapted to secure the bumper to the bottom of the boat.

3. The protective device of claim 2 wherein each of the slots are generally keyhole shaped.

4. The protective device of claim 2 wherein the adhesive is a layer of double-sided adhesive tape.

5. The protective device of claim 2 further comprising:

a notch in each wing of the bumper extending from the distal edge of each wing to permit the bumper to bend about a lateral axis and conform to the bottom of the boat.

6. The protective device of claim 5 wherein the bumper comprises a plurality of the notches.

7. The protective device of claim 6 wherein each notch is generally V-shaped.

8. The protective device of claim 2 wherein a thickness of each wing is greater proximate the bight relative to the distal edge thereof.

9. A protective device adapted to be applied to a bottom of a boat, the protective device comprising:

an elongate bumper having a generally V-shaped cross-sectional configuration with a pair of wings joined together at their proximal ends to each other at a bight of the cross-sectional configuration of the bumper;

a plurality of spaced keyhole shaped slots on an inner face of each wing proximate the bight of the bumper to cushion impact to the bottom of the boat when the bumper is installed thereon and assist in conforming the bumper to the configuration of the bottom of the boat;

at least one V-shaped notch in each wing of the bumper extending from the distal edge of each wing to permit the bumper to bend about a lateral axis and conform to the bottom of the boat; and an adhesive on the inner face of each wing proximate a distal edge thereof and being adapted to secure the bumper to the bottom of the boat.

10. The protective device of claim 9 wherein the adhesive is a layer of double-sided adhesive tape.

11. A protective device adapted to be applied to a pontoon at the bow of a pontoon boat, the protective device comprising:

an elongate bumper having a generally V-shaped cross-sectional configuration with a pair of wings joined together at their proximal ends to each other at a bight of the cross-sectional configuration of the bumper;

a plurality of spaced slots on an inner face of each wing proximate the bight of the bumper to cushion impact to the pontoon of the pontoon boat when the bumper is installed thereon and assist in conforming the bumper to the configuration of the pontoon; and an adhesive on the inner face of each wing proximate a distal edge thereof and being adapted to secure the bumper to the pontoon.

12. The protective device of claim 11 wherein each of the slots are generally keyhole shaped.

13. The protective device of claim 11 wherein the adhesive is a layer of double-sided adhesive taped.

14. The protective device of claim 11 further comprising:

a generally V-shaped notch in each wing of the bumper extending from the distal edge of each wing to permit the bumper to bend about a lateral axis and conform to a right-angle shaped pontoon.

15. The protective device of claim 14 wherein the bumper comprises a plurality of the notches to adapt the bumper for installation onto a radius shaped pontoon.

16. A method of installing a protective device onto a pontoon of a pontoon boat, the method comprising the steps of:

making a generally V-shaped notch in each wing of an elongate bumper having a generally V-shaped cross-sectional configuration with a pair of wings joined together at their proximal ends to each other at a bight of the cross-sectional configuration of the bumper, each of the V-shaped notches being aligned with one another and beginning at a distal edge of each wing and extending toward the bight of the bumper;

seating the bight of the bumper onto a vertex of the pontoon proximate the bow of the boat;

positioning each of the V-shaped notches in the bumper proximate a bend in the pontoon; and attaching at least a portion of the bumper to the pontoon so that adjacent sidewalls of each of the V-shaped notches are juxtaposed to one another and the bumper is in generally conforming relation with the pontoon.

17. The method of claim 16 further comprising:

supporting the pontoon and bumper with a support to ensure the vertex of the pontoon is properly seated in the bight of the bumper prior to completing the attaching of the bumper to the pontoon.

18. The method of claim 17 further comprising:

incrementally moving the support as portions of the bumper are attached to the pontoon.

19. The method of claim 16 further comprising making a plurality of spaced V-shaped notches in the bumper for conformance of the bumper to a radius-shaped pontoon.

20. The method of claim 16 wherein the attaching of the bumper to the pontoon further comprises adhesively attaching an inner surface of each wing to the pontoon.

21. The method of claim 20 further comprising:

temporarily bending a portion of each wing adjacent the distal edge thereof away from the pontoon about a slot in the wing to allow access to the inner surface of the wing for adhesively attaching the wing to the pontoon.

22. The method of claim 16 further comprising:

applying a sealant to an edge of the bumper and the pontoon to inhibit entry of moisture between the pontoon and the bumper installed thereon.

23. A method of installing a protective device onto a pontoon of a pontoon boat, the method comprising the steps of:

making a generally V-shaped notch in each wing of an elongate bumper having a generally V-shaped cross-sectional configuration with a pair of wings joined together at their proximal ends to each other at a bight of the cross-sectional configuration of the bumper, each of the V-shaped notches being aligned with one another and beginning at a distal edge of each wing and extending toward the bight of the bumper;

seating the bight of the bumper onto a vertex of the pontoon proximate the bow of the boat;

positioning each of the V-shaped notches in the bumper proximate a bend in the pontoon;

adhesively attaching at least a portion of the bumper to the pontoon so that adjacent sidewalls of each of the V-shaped notches are juxtaposed to one another and the bumper is in generally conforming relation with the pontoon;

supporting the pontoon and bumper with a support to ensure the vertex of the pontoon is properly seated in the bight of the bumper prior to completing the attaching of the bumper to the pontoon;

incrementally moving the support as portions of the bumper are attached to the pontoon; and applying a sealant to an edge of the bumper and the pontoon to inhibit entry of moisture between the pontoon and the bumper installed thereon.

* * * * *